US007788874B2

(12) United States Patent
Miller, Jr.

(10) Patent No.: US 7,788,874 B2
(45) Date of Patent: Sep. 7, 2010

(54) ROOFING CLIP FOR METAL ROOFING

(76) Inventor: John L. Miller, Jr., 778 First Baptist Rd., Midway, AL (US) 36053

( * ) Notice: Subject to any disclaimer, the term of this patent is extended or adjusted under 35 U.S.C. 154(b) by 464 days.

(21) Appl. No.: 10/985,245

(22) Filed: Nov. 10, 2004

(65) Prior Publication Data

US 2006/0096234 A1 May 11, 2006

(51) Int. Cl.
*E04B 1/38* (2006.01)

(52) U.S. Cl. ..... 52/712; 52/489.2; 248/497; 24/37; 24/67.1; 24/67.3

(58) Field of Classification Search ..... 52/522, 52/712, 489.1, 481.2, 357, 550, 489.2; 24/67, 24/67 R, 67.3, 30.5 P, 54.3, 30.5 S, 37, 67.1, 24/67.5, 68 R, 68 PP; 248/71, 74.1, 317, 248/493, 497

See application file for complete search history.

(56) References Cited

U.S. PATENT DOCUMENTS 1,793,127 A * 2/1931 Osius ..... 52/772
1,838,120 A * 12/1931 Venzie ..... 52/357
2,015,129 A * 9/1935 Voigt et al. ..... 52/550
2,108,611 A * 2/1938 Richardson ..... 52/489.1
2,172,302 A * 9/1939 Tinnerman ..... 24/581.1
2,488,887 A * 11/1949 Adams ..... 52/531
2,594,194 A * 4/1952 Metsger ..... 277/589
2,760,674 A * 8/1956 Karp ..... 220/326
2,922,733 A * 1/1960 Henning ..... 428/83
2,926,742 A * 3/1960 Fischer ..... 52/144
3,297,815 A * 1/1967 Drettmann ..... 174/507
3,376,004 A * 4/1968 Goldman ..... 248/74.3
3,438,168 A * 4/1969 Tischuk ..... 52/478
3,815,309 A * 6/1974 Olsen ..... 52/506.08
3,858,373 A 1/1975 Day
3,906,592 A * 9/1975 Sakasegawa et al. ..... 248/68.1
4,089,145 A 5/1978 DeVries
4,102,105 A 7/1978 Taylor
4,139,974 A 2/1979 Fox
4,141,107 A * 2/1979 Sheiman et al. ..... 16/221
4,307,976 A * 12/1981 Butler ..... 405/118
4,497,151 A 2/1985 Simpson
4,514,952 A 5/1985 Johansson
4,533,102 A * 8/1985 Ferrell ..... 248/74.1
4,575,983 A 3/1986 Lott
4,706,342 A * 11/1987 Yu ..... 24/67.9
4,807,414 A 2/1989 Krause
4,904,104 A * 2/1990 Gloeckle ..... 402/80 R
4,918,893 A * 4/1990 Vandenbroucke et al. .. 52/404.2
4,926,608 A * 5/1990 Beauregard ..... 52/522

(Continued)

*Primary Examiner*—Richard E Chilcot, Jr.
*Assistant Examiner*—Chi Q Nguyen
(74) *Attorney, Agent, or Firm*—Bradley, Arant Boult Cummings, LLP; Thad G. Long; Nicholas J. Landau

(57) ABSTRACT

A roofing clip and connector for retaining metal roofing panels to the purlins of roofs comprising a rigid clip piece in the form of a folded piece of material with a loop in the vicinity of the fold and a constricted area between the loop and the folded ends of the materials, with holes to facilitate attachment of the clip to the purlins, and with the upper fold of the clip having an upturned segment more than 69 degrees at the end thereof, and a connector to be inserted into the clip, with a tab extension extending laterally from the connector.

11 Claims, 3 Drawing Sheets

U.S. PATENT DOCUMENTS 5,001,882 A 3/1991 Watkins
5,127,205 A 7/1992 Eidson
5,220,710 A * 6/1993 Laudan et al. ..... 24/279
5,222,340 A 6/1993 Bellem
5,363,624 A 11/1994 Cotter
5,408,796 A * 4/1995 Hashimoto et al. ..... 52/489.2
5,423,576 A * 6/1995 Hunter ..... 285/288.1
5,499,789 A * 3/1996 Rose ..... 248/489
5,511,354 A 4/1996 Eidson
5,634,314 A * 6/1997 Champagne ..... 52/712
5,765,873 A * 6/1998 Chen ..... 281/45
5,911,663 A 6/1999 Eidson
5,970,586 A * 10/1999 Demel et al. ..... 24/555
6,070,837 A * 6/2000 Bond ..... 248/71
6,385,935 B2 * 5/2002 Lippy ..... 52/512
6,508,442 B1 * 1/2003 Dolez ..... 248/74.1
6,715,256 B1 4/2004 Fischer
6,715,720 B2 * 4/2004 Finn ..... 248/71
6,941,716 B2 * 9/2005 Kottman ..... 52/489.1
7,120,969 B2 * 10/2006 Carls ..... 24/67.3

* cited by examiner

ROOFING CLIP FOR METAL ROOFING

BACKGROUND OF INVENTION

Metal roofs, though in use for centuries, have in recent years become increasingly popular for commercial, residential or other uses, and with such popularity there is an increased need for better roofing clips for attaching the metal roof panels to the purlins of the roof structure.

Metal roofs are strong, fire-resistant and durable, and they now come with many finishes and in various styles which sometimes simulate the look of non-metal roofing materials such as tile or slate.

However, metal expands or contracts with temperature changes to a greater degree than some other roofing materials. Therefore, for extended lengths of metal roofing, where the quantitative amount of expansion and construction can be considerable, nailing or screwing the metal to the purlins of the roof structure is not satisfactory because of buckling that can occur, or even the pulling loose or shearing of the fasteners. To deal with this expansion/contraction characteristic of metal roofs, it is customary to utilize roofing clips, usually of metal, that will allow for a certain amount of expansion and contraction by allowing a metal piece interfacing or engaging with the metal roof to slide within a limited range provided by the clips attached to the purlin.

The present invention is a roofing clip and connector designed to provide greater strength and stability to an installed roof system than in the past, especially through angling upward the end portion of the upper fold layer of the clip as will be shown below, together with provision of a tab extension for the connector.

DETAILED DESCRIPTION OF THE DRAWING

Figure 1:
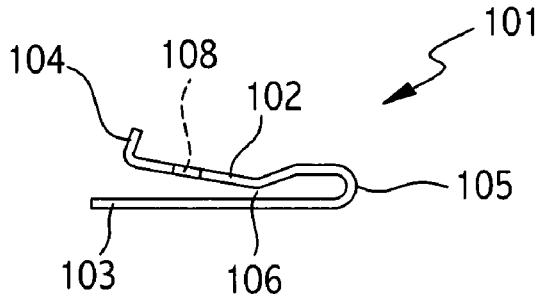
FIG. 1 is a side view of a roofing clip.

Referring to FIG. 1, a rigid, preferably metal, roofing clip 101 is shown in a side view in which top fold 102 is configured to lie above lower fold layer (sometimes referred to as "folds") 103 to form a narrow constriction 106 between the upper and lower folds. The constriction makes it difficult to extract a properly designed connector, inserted laterally into the clip, when an extractive force is exerted in a direction generally away from tip point 105 through the mouth of the clip. In practice, a piece of sheet metal of suitable size is mechanically bent to make the fold, leaving a somewhat wider loop in the area near tip point 105, with a constriction at point 106, an upturn at or toward the end of upper fold 102. An upturned segment 104 of approximately 70° or more counterclockwise from the horizontal has been found to have several advantages over the existing art which generally has no upturn at such corresponding parts of metal roofing clips. Insertion of the connector 201 (see FIGS. 3-6) is easier; the clip gains added strength in the area of segment 104; and a horizontal edge is eliminated which is less likely to be abrasive of the connector 201 when there is movement of the connector 201 relative to clip 101 caused by wind, expansion and contraction of metal, and other causes. It is found in laboratory testing that clips having the upturned segment 104 have considerably greater resistance to failure from forces and stresses than those without such upturned segment.

Figure 2:
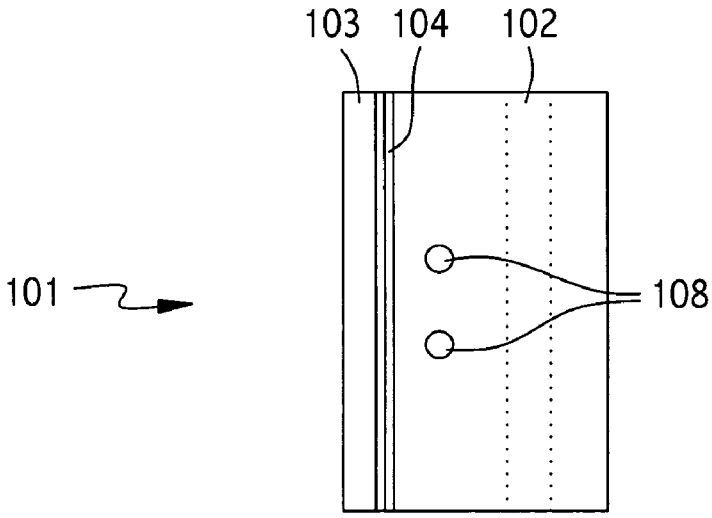
FIG. 2 is a view of a clip seen from above, showing the upper narrower portion folded back over the lower, longer portion and showing to fastener holes through each fold layer.

Referring to FIG. 2, the clip is shown in a top view, showing fastener holes 108 (preferably by not necessarily dimpled downward) extending in line through both upper fold 102 and lower fold 103, said holes intended usually for nails or screws. Two pairs of holes are shown and are preferred for stability and strength, but any number, one, two or more, could be used with reasonably satisfactory results. Fasteners are inserted through the holes 108 into the purlins of the roof structure, after connectors have been inserted laterally into the clips, thus securing the clips and connectors to the purlins.

Figure 3:
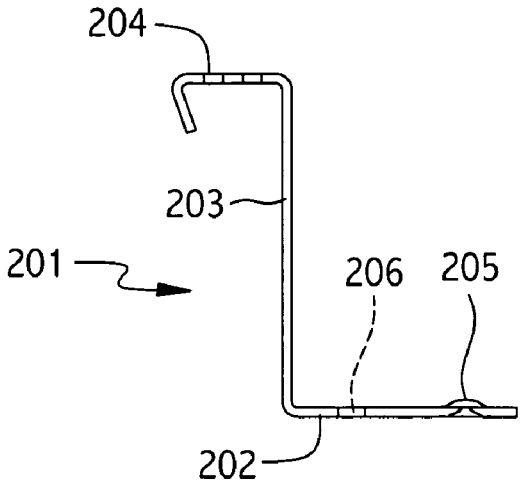
FIG. 3 is a view of a connector to be held between the folds of the clip.

FIG. 3 is a side view of a connector 201 designed to be inserted laterally into a clip 101. A leg 202 of the connector to be inserted into the clip has a hump or dimple 205 which extends at least a part of the width of the connector 202 with a generally parallel slot 206 spaced farther from the extremity of the insertion leg 202 than the hump 205. The connector 201 bends upward from the insertion leg 202 to form leg 203, at the end of which there is an interface means 204 designed to engage with and hold a panel of metal roofing, which interface means would typically include a relatively flat surface to touch against or approach closely the bottom of a panel of metal roof so that screws or nuts and bolts or other fasteners can join the metal roof panel to the connector. The interface means could also include hooks, clasps, snaps, and other well known means for engaging and retaining two objects together. Typically, the edges of metal roof panels are crimped around segment 204, and such edges and segment 204 are together bent and crimped inwardly toward segment 203 in order securely to retain the roof panels. When the connector 201 is slid laterally into clip 101, the hump 205 fits into the toe or loop near 105 of FIG. 1, and the constriction 106 of the clip helps prevent the connector from being removable in the extraction direction running from point 105 through the toe loop toward point 104.

Figure 4:
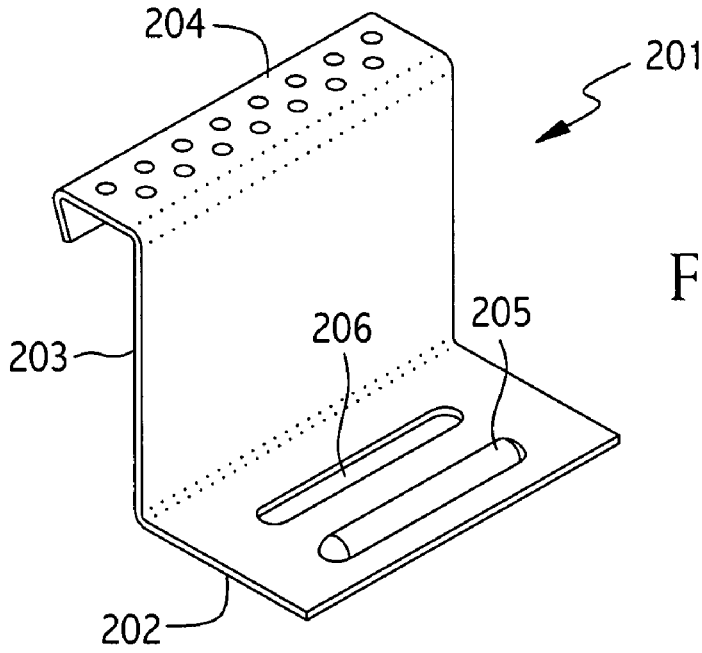
FIG. 4 is a perspective view of the connector.

FIG. 4 shows connector 201 from a perspective point of view showing hump 205 and slot 206 in insertion leg 202, as well as leg 203 culminating in hook or clasp 204. The slot 206 is positioned so that it will fall in line with, and within a plane between, the fastener holes 108 of the two fold layers in clip 101, when the connector 201 is inserted laterally into clip 101. However, slot 206 is wider than the longest straight line that can be drawn from any point on the circumference of any hole 108 to any other point on any hole 108. The result is that, when connector 201 is inserted fully into clip 101, and then fasteners are also inserted via holes 108 through the two folds 102 and 106 of clip 101, the connector can slide laterally for a distance until an end of slot 206 comes into contact with a fastener and is thereby stopped. This ability of the connector 201 to slide laterally for a discrete and limited distance will accommodate expansions and contractions of metal roofing engaged by the connector, and thereby will retain the metal roofing substantially intact without warping or bunching or sheer stresses which might otherwise occur. The degree of sliding allowed by the clip/connector combination is determined by the coefficient of expansion and contraction of the metal roofing material and by the range of cold and hot temperatures anticipated to affect the metal roofing materials and thus cause such expansion and contraction of metal, as well as the length of a metal roof panel being secured.

Figure 5:
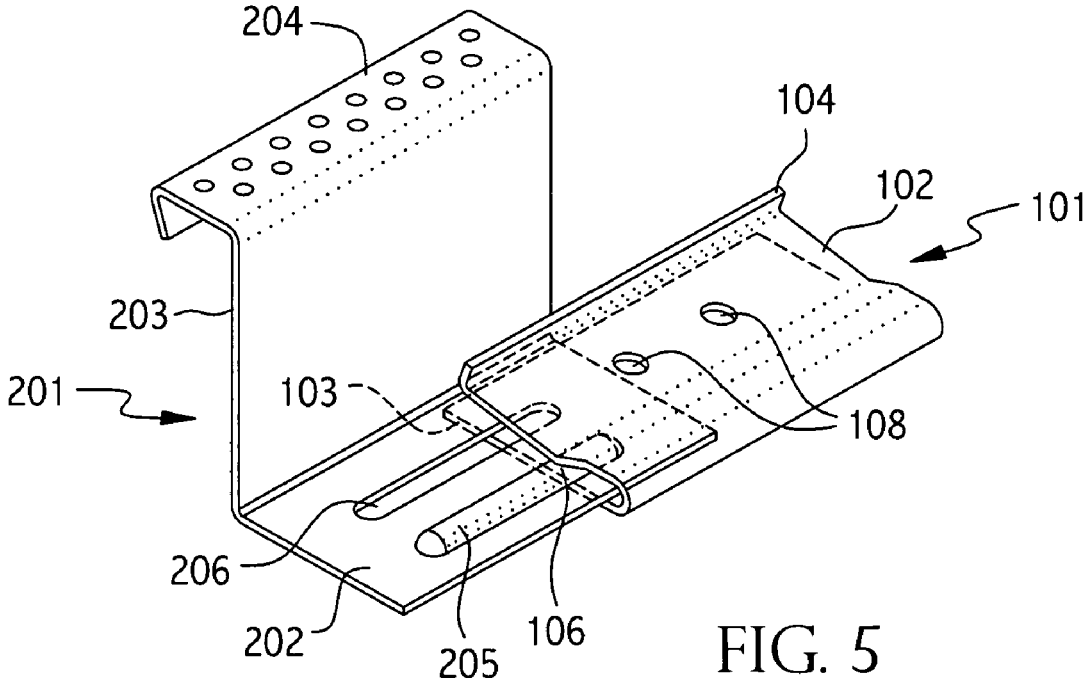
FIG. 5 is a view of the connector in the process of being inserted into the folds of the clip.

FIG. 5 shows connector 201 in the process of being inserted laterally into clip 101, showing how the slot 206 falls directly between and in line with the holes 108 in the upper fold of the clip and the corresponding holes 108 in the lower fold of the clip. FIG. 5 also shows how hump 205 slides within the loop or toe 105 of the clip to prevent or make difficult extraction in a direction past constriction 106 from loop or toe point 105 to end segment 104. The interface means 204 (shown in FIGS. 4 and 5 with typical holes, which are not essential nor particularly relevant to this invention) will be at the end of upright segment 203 above the engaging portions of the clip and connector.

Figure 6:
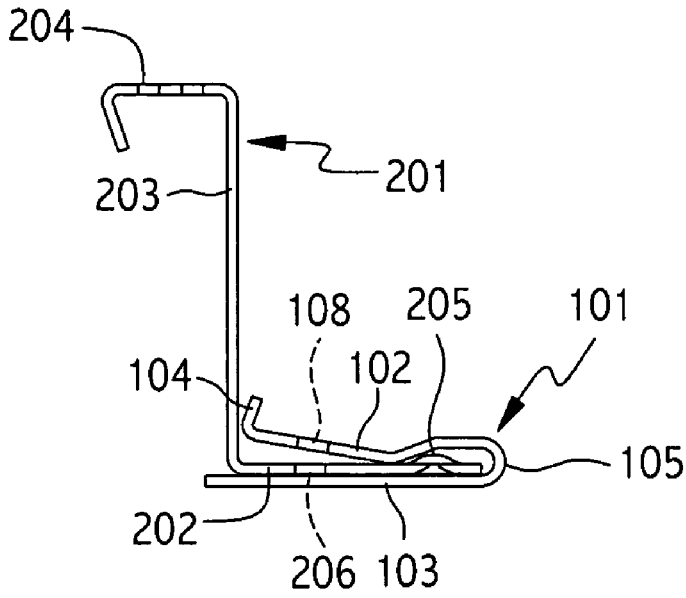
FIG. 6 is a side view showing the connector fully inserted into the clip.

FIG. 6 is a side view of the combined clip 101 and connector 201 showing the connector inserted into the clip. As noted earlier, there are substantial advantages in angling the end 104 upwards about 70° or more in a counter-clockwise direction from the horizontal.

Figure 7:
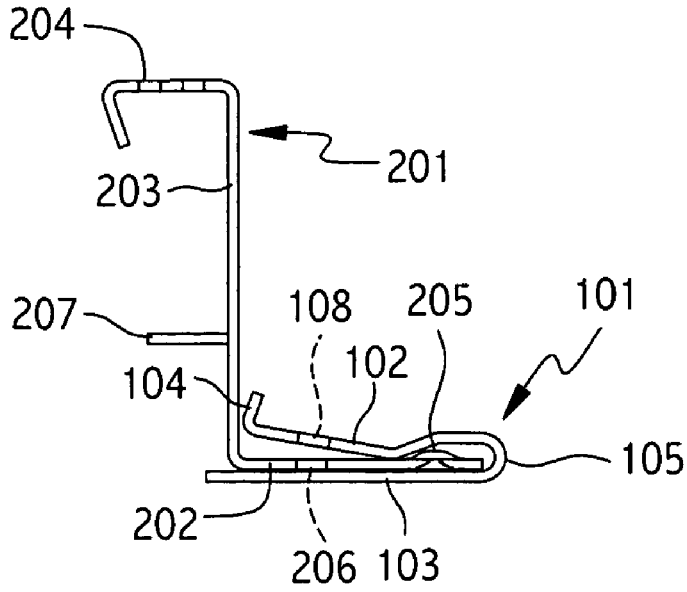
FIG. 7 is a side view showing the connector fully inserted into the clip, and with a tab extension extending from the connector.

FIG. 7 shows a different configuration of the clip/connector combination, in which one or more tab extensions 207 extend from segment 203, at a sufficient distance below segment 204 so as not to interfere with the crimping or other attachment of the edge of metal roof panels to the connector. Usually it would be desirable to position such tab extensions so that they are on the same side and extend in substantially the same direction as segment 204, since the bulge or loop in the toe of the clip in the vicinity of 105 will generally serve a somewhat equivalent function on the opposite side, but one or more tab extensions could extend in either direction on either side. Such tab extension or extensions are helpful to insure that the metal roof panels do not touch or rub against any purlins or stationary structural components of the roof structure below the metal roof panels, which would cause a drag on the metal roof panels as they expand and contract. Such one or more tab extensions, or ledges, can be formed by punching out a partial hole and bending outwardly the metal tab so formed or, alternatively, they could be welded onto segment 203, preferably on the back side, or otherwise attached to segment 203. With the use of such tab extensions, the upwardly bent segment 104 of the preceding FIGS. 1, 20, 5 and 6 is unnecessary and has been eliminated from FIG. 7.

What is claimed is:

1. A roofing clip of material having an upper fold layer, and a lower fold layer longer than the upper fold layer, comprising:

a. a fold;

b. a loop in the vicinity of the fold;

c. a constriction relative to the separation of the two fold layers at the end of the loop distant from the fold;

d. at least one fastener hole extending concentrically through both fold layers; and e. a portion of the upper fold layer angled upward at the end thereof located on the side of the fastener hole opposite the constriction;

wherein the constriction is positioned between the fastener hole and the loop.

2. The roofing clip as described in claim 1 wherein the material is a metal.

3. The roofing clip as described in claim 2 wherein there are two holes each extending through both fold layers.

4. The roofing clip as described in claim 3 wherein said portion of the upper fold area is angled upward in a range in excess of 69 degrees.

5. The roofing clip as described in claim 2 wherein said portion of the upper fold area is angled upward in a range in excess of 69 degrees.

6. The roofing clip as described in claim 1 wherein there are two holes, each extending through both fold layers concentrically.

7. The roofing clip as described in claim 1 wherein said portion of the upper fold area is angled upward in a range in excess of 69 degrees.

8. A roofing clip and connector system, comprising:

a. the roofing clip of claim 1; and b. a connector inserted laterally into the roofing clip, said connector comprising:

i. an insertion leg comprising a dimple extending at least a part of the width of the connector and a slot, the slot being substantially parallel to the dimple and being wider than the longest straight line that can be drawn from any point on the circumference of the fastener hole to any other point on the circumference of the fastener hole; and ii. an upper leg bending upward from the insertion leg.

9. The roofing clip and connector system as described in claim 8, further comprising an interface means at the end of the upper leg opposite the insertion leg.

10. The roofing clip and connector system as described in claim 8 wherein said portion of the upper fold area is angled upward in a range in excess of 69 degrees.

11. The roofing clip and connector system as described in claim 8, the roofing clip comprising two of said fastener holes, and wherein the slot is wider than the longest straight line that can be drawn from any point on the circumference of any fastener hole to any other point on the circumference of any fastener hole.

* * * * *